US005541481A

United States Patent [19]

Yamaguchi et al.

[11] Patent Number: 5,541,481

[45] Date of Patent: Jul. 30, 1996

[54] CADMIUM ARC LAMP WITH IMPROVED UV EMISSION

[75] Inventors: Akiyasu Yamaguchi; Yukio Yasuda; Hiromitsu Matsuno; Tatsushi Igarashi, all of Himeji, Japan

[73] Assignee: Ushiodenki Kabushiki Kaisha, Japan

[21] Appl. No.: 282,267

[22] Filed: Jul. 29, 1994

[30] Foreign Application Priority Data

| | | | |
|---|---|---|---|
| Aug. 3, 1993 | [JP] | Japan | 5-209988 |
| Aug. 3, 1993 | [JP] | Japan | 5-209991 |
| Aug. 19, 1993 | [JP] | Japan | 5-225069 |

[51] Int. Cl.[6] ..... H01J 61/18

[52] U.S. Cl. ..... 313/638; 313/637; 313/643

[58] Field of Search ..... 313/638, 640, 313/641, 642, 637, 639, 643

[56] References Cited

U.S. PATENT DOCUMENTS

| | | | |
|---|---|---|---|
| 2,707,247 | 4/1955 | Anderson, Jr. | 313/642 |
| 4,156,826 | 5/1979 | Hernquist | 313/636 |
| 4,439,711 | 3/1984 | Murakami et al. | 313/639 |
| 4,701,664 | 10/1987 | Larve et al. | 313/114 |
| 4,884,009 | 11/1989 | Rothwell, Jr. et al. | 313/637 |

FOREIGN PATENT DOCUMENTS

| | | | |
|---|---|---|---|
| 55010757 | 1/1980 | Japan | H01J 61/16 |
| 1639112 | 3/1978 | United Kingdom . | |

*Primary Examiner*—Michael Horabik
*Assistant Examiner*—Michael Day
*Attorney, Agent, or Firm*—Sixbey, Friedman, Leedom & Ferguson, P.C.; David S. Safran

[57] ABSTRACT

A cadmium rare gas discharge lamp of the short arc type that has a high power of the spectra in a wavelength range of 210 nm to 230 nm and a stable lamp voltage in lighting operation for a long period. An arc tube 1 is provided within which are disposed opposed, spaced apart electrodes 2, 3 and thermal insulation films 6, 7. A rare gas is encapsulated together with metal cadmium and a quartz glass is used for the material of the arc tube whose OH radical has a weight content of no more than 200 ppm. Electrodes 4 and 5 are spaced apart no more than 10 mm, so that with a lamp current at least 20 amperes, an arc of the electrode-stable type is formed and radiant light of Cd ions obtained. For the encapsulated rare gas, in one embodiment at least one of the rare gases neon, argon or krypton, are used and are encapsulated at a gas pressure of 35 kPa to 2.5 MPa at a standard temperature of 25° C. The arc tube 1 is formed of quartz glass, electrodes 2 and 3 are placed opposite one another. In another embodiment, a halogen gas is encapsulated in the arc to in an amount from $4.5\times10^{-10}$ mol/cm$^3$ of arc tube volume to $2.1\times10^{-7}$ mol/cm$^3$ of are tube volume.

5 Claims, 9 Drawing Sheets

| OH Radical Concentration in Quartz Glass Arc Tube | Light Duration at Which Voltage Fluctuation is at least 5% |
|---|---|
| 1500 weight - ppm | 32 hours |
| 800 weight - ppm | 61 hours |
| 200 weight - ppm | 320 hours |
| 8 weight - ppm | 1000 hours |

FIG.7

| Lamp Type | Gas Type | Press. (MPa) | Lamp Voltage (V) | Lamp Current (A) | Power (KW) | Relative Intensity Q | Relative Light Effic. η | Judgement |
|---|---|---|---|---|---|---|---|---|
| Comp. Examples | | | | | | | | |
| Lamp A | Xe | 0.05 | 20.5 | 70.0 | 1.44 | 193 | 1.34 | Δ |
| Lamp B | | 0.36 | 27.7 | 85.6 | 2.37 | 237 | 1.00 | X |
| Lamp C | | 1.00 | 37.2 | 74.8 | 2.78 | 245 | 0.88 | X |
| Comp. Examples | | | | | | | | |
| Lamp D | Kr | 0.04 | 19.2 | 65.3 | 1.25 | 189 | 1.51 | ○ |
| Lamp E | | 0.34 | 23.1 | 95.9 | 2.22 | 349 | 1.57 | ○ |
| Lamp F | | 0.89 | 27.8 | 85.0 | 2.36 | 392 | 1.66 | ○ |
| Lamp G | Ar | 0.04 | 19.8 | 76.1 | 1.51 | 333 | 1.54 | ○ |
| Lamp H | | 0.30 | 24.7 | 70.5 | 1.74 | 350 | 2.01 | ○ |
| Lamp I | | 1.10 | 31.8 | 78.9 | 2.51 | 660 | 2.63 | ○ |
| Lamp J | Ne | 0.05 | 19.5 | 72.4 | 1.41 | 231 | 1.64 | ○ |
| Lamp K | | 0.22 | 23.6 | 77.3 | 1.82 | 389 | 2.14 | ○ |

CADMIUM ARC LAMP WITH IMPROVED UV EMISSION

BACKGROUND OF THE INVENTION

1. Field of the Invention

The invention relates to a cadmium/rare gas discharge lamp of the short arc type in which cadmium and rare gas contribute to a discharge emission. The invention relates in particular to a cadmium/rare gas discharge lamp of the short arc type that is suited for light sources of optical devices in which ultraviolet rays are used.

The invention further relates to a cadmium/rare gas discharge lamp of the short arc type that emits ion lines in a C-range with high energy exchange efficiency, and the ion lines are emitted from ultraviolet rays of cadmium ions.

The invention further relates to a cadmium metal vapor discharge lamp in which an emission of cadmium ions is used. The invention relates in particular to a cadmium metal vapor discharge lamp that is suited for light sources of optical devices in which ultraviolet rays are used.

2. Description of Related Art

As is known, optical devices in which ultraviolet rays are used are widely used for industrial applications such as for reforming plastic surfaces, for photo chemical vapor deposition (CVD), for photo-incineration, for UV curing in which a certain wavelength is needed, for photolithography and for similar purposes.

When using light in a wavelength of 185 nm to 300 nm, it is usually desired to use a metal/rare gas discharge lamp such as a xenon-mercury lamp or a xenon cadmium lamp. It is purported that, when using light in particular in a wavelength of 220±20 nm, a xenon/cadmium discharge lamp is suitable, as, for example, it can be concluded from Japanese laidopen specification SHO 55-10757 entitled "Cadmium/rare Gas Discharge Lamp of the Short Arc Type."

In Japanese laid-open specification SHO 55-10757, it is pointed out that, by determining the encapsulation amount of cadmium and rare gas, radiation in a wavelength around 220 nm can be intensified, which can shorten the heat curing time in a production operation of a semiconductor device.

Emission spectra of a cadmium lamp in a wavelength range of 210 nm to 230 nm are achieved because of a subtle balance of the density of the distribution number of cadmium atoms, ions and molecules that are in a ground state. To achieve a needed form of the spectra it is therefore necessary to achieve a suitable density and a suitable vapor pressure by controlling an encapsulation amount of cadmium.

The density of the amount of cadmium and of cadmium vapor pressure inside a discharge space are, on the other hand, very strongly influenced by the temperature of the coolest part of the arc tube in a lighting operation. As a result of this, the temperature of the coolest part also exerts a strong influence on the distribution of emission spectra.

The propagation of band spectra of $Cd_2$ that contain, because of a certain encapsulation amount of cadmium, fine spectra of monovalent Cd ions with a wavelength of 214.4 nm, reacts, for example, very sensitively on the vapor pressure of the cadmium. To intensify the radiation wavelength in a wavelength range around about 220 nm, it is therefore necessary, in a cadmium lamp, to stabilize the intensity of the band spectra including 214.4 nm by performing any thermal insulation or any temperature regulation of the tube wall, so that a sufficient vapor pressure of the cadmium can be achieved.

But, in a lamp in which a thermal insulation or any temperature regulation of the tube wall is performed, in this way, to keep the vapor pressure under control, it is considered a drawback that the lamp voltage fluctuates after a short period.

In connection with a cadmium/rare gas discharge lamp of the short arc type, the following is to be noted.

It is known that inert gas that is encapsulated in a cadmium vapor discharge lamp, which hereafter is referred to only as a cadmium lamp, has two functions, namely, a thermal insulating effect to achieve a metal vapor pressure required for emission within a lamp bulb or a simplification of a transition from a glow discharge to an arc discharge, i.e., an improved startup characteristic.

The above-described circumstances do not exclude a cadmium lamp usually used in practice either, in which Xe gas with slight thermal conductivity is often used as the inert gas.

As can be concluded, for example, from the Japanese laid-open specification SHO 55-10757 entitled "Cadmium/rare Gas Discharge Lamp of the Short Arc Type" or German patent 16 39 112 entitled "Metal Vapor Discharge Lamp for Photochemical Purposes," Xe gas is described as a suitable inert gas in embodiments.

But, the present inventors have found out, by experiments in which Xe gas was selected as the inert gas and a relationship was investigated between an encapsulation pressure of the Xe gas and a light efficiency of light radiated as ultraviolet rays in a wavelength range of 200 nm to 250 nm, that the light efficiency is reduced as a function of an increase in the encapsulation pressure of the Xe gas.

A light efficiency of ultraviolet rays in a C-range in a cadmium lamp, i.e., in a wavelength range of less than or equal to 250 nm, can also regulated by cadmium vapor pressure and by lamp current. That means that the light efficiency, as a result of a self-absorption of a resonance line with 228.8 nm of a neutral cadmium, goes down when, to achieve high light efficiency, the cadmium vapor pressure is excessively raised. If, on the other hand, the cadmium vapor pressure is too low, a density of a distribution number in an excitation state connected with emission, and thus the light efficiency, go down.

To increase light efficiency at a suitable cadmium vapor pressure by excitation with high efficiency in an excitation state connected with emission, it is generally known, frequently, to use inert gas which, to increase gas temperature of an arc, exhibits an ionization potential that is higher than the ionization potential of an emission substance.

Starting from the above-described circumstances, Xe gas is used in a cadmium lamp, Xe gas that is encapsulated in a relatively simple way during a production operation of the lamp. Since an ionization potential of cadmium atoms is 8.99 eV and an ionization potential of Xe atoms is 12.13 eV, the above-described condition-is thus fulfilled.

But, by experiments of the present inventors, it was determined that, by increasing the encapsulation pressure of the Xe gas to increase the gas temperature of the arc, the light efficiency of the cadmium lamp in the wavelength range of 200 nm to 250 nm goes down, because input energy is not used to excite the cadmium but, as a result of the excitation of the Xe gas, a large amount of energy is used. Therefore, it was difficult to increase the light efficiency of the cadmium in the wavelength range of 200 nm to 250 nm.

It is generally known for a cadmium metal vapor discharge lamp (hereafter referred to only as a cadmium lamp) that, when using cadmium as the main emission substance, it uses line spectra of neutral cadmium, for example, a radiation wavelength of 228.8 nm or the like.

Recently wavelengths of light that is used for industrial applications are becoming increasingly shorter, corresponding to the requirements in the development of photochemical industries, production fields of semiconductor devices or the like.

But, in a cadmium lamp using a resonance line with an emission wavelength of 228.8 nm from cadmium, as a result of a self-absorption phenomenon, it can happen that insufficient light intensity is achieved if, to achieve a strong light from cadmium, cadmium partial pressure is increased during operation. If, on the other hand, to avoid the self-absorption phenomenon, the partial pressure is reduced during operation, it can happen that, as a result of reduced emission substance, a light intensity sufficient for industrial applications is not achieved either.

To eliminate the above-described drawback, a cadmium lamp is investigated that uses emission from cadmium ions. In this cadmium lamp, a considerably higher density of cadmium ions is used than in a conventional cadmium lamp.

But, a cadmium lamp using cadmium ions that radiates shortwave light at an intensity sufficient for industrial applications has the same drawback of such a cadmium lamp that is caused by the fact that it is necessary to produce, within a tube, a density of cadmium ions that is unusually high for a conventional cadmium lamp. This drawback consists in that, during a relatively short lighting period, a cloudiness, i.e., a so-called devitrification phenomenon, occurs on an inner side of the tube and in that, as a result of this, after a relatively short period of use of the lamp, sufficient light cannot be obtained any more.

SUMMARY OF THE INVENTION

The invention was made to eliminate the above-named drawbacks. The primary object of the invention is to provide a cadmium/rare gas discharge lamp of the short arc type that has high intensity of the spectra in a wavelength range of 210 nm to 230 nm and a stable lamp current during lighting operation over a long period.

This object is achieved according to the invention in that, in a cadmium/rare gas discharge lamp of the short arc type in which, inside an arc tube provided with a pair of adjacent electrodes placed opposite one another, an arc tube whose temperature is regulated with an outside tube, a thermal insulation film or a similar means, there is encapsulated, together with metal cadmium at a pressure of 14 kPa to 200 kPa in stationary lighting operation, a rare gas for which one of the rare gases xenon, krypton, argon or neon, or several of these rare gases, is/are selected, quartz glass is used as the material for the arc tube, quartz glass whose OH radical content is a weight of less than or equal to 200 ppm.

The present inventors have found out that the cause of the fluctuation of the lamp voltage lies in $H_2O$ that is emitted from the OH radical contained in the material of the arc tube.

If the temperature of the arc tube increases, $H_2O$ is emitted, which is split into oxygen and hydrogen within the discharge space. If only a small amount of it is emitted, the oxygen reacts with tantalum, zirconium or the like, which is encapsulated as getter, and is occluded. However, if a large amount water is emitted, it oxidizes the electrodes, accelerating the vaporization of the material components of the electrodes, resulting in deformation of the electrodes and making the electrode emission performance unstable.

The hydrogen, on the other hand, is absorbed by the above-described getter. Because this, however, is a reversible reaction, excess hydrogen remains in a large amount also in the discharge space. If the hydrogen in the discharge space increases, the lamp voltage increases.

Because the two above-described phenomena both occur in this way together, they cause a fluctuation in the lamp voltage, and thus, an unstable light output.

To absorb the oxygen and the hydrogen, the above-described getter is encapsulated inside the arc tube. But, the encapsulated amount is limited. In a test of lowering the temperature of the arc tube to reduce the emitted amount of $H_2O$, no high intensity of the spectra in the wavelength range of 210 nm to 230 nm can be achieved, as a result of a reduction in the cadmium vapor pressure inside the lamp occurs.

The present inventors investigated materials with various contents of OH radical at a weight in quartz glass that is used as a material for the arc tube. As a result, they found out that by having, at a temperature of the arc tube at which a vapor pressure of the metal cadmium of 14 Kpa to 200 kPa is achieved, the content of the OH radical in the material of the arc tube at a weight of less than or equal to 200 ppm, only a small amount of $H_2O$ is emitted from the material of the arc tube and that, thus, the above-described drawback can be eliminated.

It is generally known that it is necessary, in a metal halogenide discharge lamp in which a metal iodide or a metal bromide is encapsulated and in which, by discharge, a metal emission is achieved, to use quartz glass with a small amount of OH radical for the material of the arc tube. But, the reason for this lies in the fact that, as a result of a reaction of the metal getter with the encapsulated halogen, no getter is to be used.

In a xenon lamp or a mercury lamp of the short arc type, using a getter, it is true that quartz glass with an OH radical content of greater than or equal to 200 ppm can be used for the arc tube. However, in a cadmium/rare gas discharge lamp of the short arc type, in contrast to a metal halogenide discharge lamp, a getter can be used. But here, despite use of the getter, a calculation of the OH radical of the arc tube is necessary.

Thus, a further object of the invention is to provide a cadmium/rare gas discharge lamp of the short arc type in which, by the type of inert gas used and a suitable encapsulation pressure, the arc temperature is increased and simultaneously cadmium atoms with high efficiency are excited, and in which cadmium ions are produced as carders of the lamp current and thus cadmium spectra in a wavelength range of 210 nm to 230 nm are radiated at high efficiency.

This further object is achieved according to the invention in that, in a cadmium/rare gas discharge lamp of the short arc type in which, inside an arc tube provided with a thermal insulating means, a pair of electrodes is placed opposite one another less than or equal to 10 mm apart, at a lamp current of greater than or equal to 20 amperes, an arc of the electrodestable type is formed and radiant light from Cd ions is used, rare gas is encapsulated, for which one of the rare gases neon, argon or krypton, or several of these rare gases is/are selected, and in that the above-described rare gas is encapsulated at an encapsulation pressure of 35 kPa to 2.5 MPa at a standard temperature of 25° C.

By the above-described arrangement, a sufficiently high arc temperature can be achieved inside an arc discharge space in the lamp and ions of an emission element can be produced in a relatively large amount, ions that can function as one of the carders of the lamp current. Therefore, after collision reaction processes of electrons and atoms, the density of the distribution number of the excitation state connected with emission can be increased.

With the use of rare gases that exhibit ionization potential that is sufficiently higher than the ionization potential of cadmium, i.e., when using Kr, Ar and Ne as the inert gas, the gas temperature inside the discharge space increases and the density of the distribution number of the excitation state is increased.

Simultaneously, in comparison to ionization of the inert gases, ionization of cadmium as the emission substance is accelerated. Consequently, the ionization of the emission substance dominates and thus the cadmium ions, which are one of the carders of the lamp current, multiply. The ions collide with atoms and electrons and increase the density of the distribution number of an excitation level connected with an emission in the wavelength range of 200 nm to 250 nm. The result of this clearly appears in connection with a pressure increase of the encapsulated gas.

If the pressure of the encapsulated gas decreases, the thermal insulating effect of an arc column is reduced, especially when the pressure, at room temperature, is less than 35 kPa, and a great disruption of the emission can occur as a result of only one slight change in the outside environment. Further, as a result of an inefficient effect of the inert gas on the increase in the temperature of the arc column, the light efficiency decreases.

If, on the other hand, the pressure of the encapsulated gas is increased, it is true that the light efficiency increases considerably. However, in doing so there is an upper limit for the pressure of the encapsulated gas. This pressure is determined by the breaking strength of the gas, which is defined by the operating gas pressure inside the lamp. This encapsulation pressure is 2.5 MPa at room temperature.

Thus, another object of the invention is to provide a cadmium-metal vapor discharge lamp which has an emission in a wavelength range of 200 nm to 250 nm for a sufficiently long time that can be used for industrial applications, by preventing devitrification on an inner side of a bulb that is part of a cadmium lamp using cadmium ions.

The object is achieved according to the invention in that, in a cadmium-metal vapor discharge lamp, which is a short-arc lamp using ion lines of cadmium, a halogen is encapsulated, in an amount of $4.5\times10^{-10}$ mol/cm$^3$ of arc tube volume to $2.1\times10^{-7}$ mol/cm$^3$ of arc tube volume, when it is converted into a biatomic halogen molecule.

This object according to the invention is further achieved, advantageously, in that iodine is used as the halogen.

According to the invention, in a lighting operation of the cadmium lamp, a large amount of cadmium ions and cadmium atoms with high energy is produced inside an arc.

In the case where no halogen is encapsulated, these cadmium ions or cadmium atoms with the high energy directly reach an inner side of the bulb and react with it. In doing so, a so-called devitrification phenomenon arises in which transmittance of the bulb goes down.

If, on the other hand, halogen is encapsulated, the cadmium ions and cadmium atoms with high energy produced inside the arc collide with halogen atoms or halogen molecules. Consequently, the number of cadmium ions and cadmium atoms with high energy that directly reach the inside of the bulb decreases sufficiently.

From experiments of the present inventors, it was found out that insufficient prevention of the above-described devitrification phenomenon results if the encapsulated amount of halogen is less than $4.5\times10^{-10}$ mol/cm$^3$. However, if the amount of encapsulated halogen is greater than or equal to $4.5\times10^{-10}$ mol/cm$^3$, the devitrification phenomenon is sufficiently prevented. On the other hand, with an amount of halogen greater than $2.1\times10^{-7}$ mol/cm$^3$, the light intensity produced mainly by an emission of the cadmium ions in a wavelength range of 200 nm to 250 nm is weakened as a result of light absorption by the halogen.

Thus, it was found out that, with an encapsulation amount of the halogen of $4.5\times10^{-10}$ mol/cm$^3$ to $2.1\times10^{-7}$ mol/cm$^3$, light with a greater intensity can be achieved for a longer period because, as a result of a reduced number of cadmium ions and cadmium atoms with high energy that react with the inner side of the bulb, the so-called devitrification on the inner side of the bulb does not easily occur, and because, simultaneously, light absorption by the halogen occurs only to a slight extent.

These and further objects, features and advantages of the present invention will become apparent from the following description when taken in connection with the accompanying drawings which, for purposes of illustration only, show several embodiments in accordance with the present invention.

BRIEF DESCRIPTION OF THE DRAWINGS

FIG. 7 is a tabular representation of data reflecting the results of tests in which, in the cadmium lamp according to the invention according to FIG. 5 and conventional cadmium lamps, various types of encapsulated gases and pressures of the encapsulated gases were considered as parameters;

DETAILED DESCRIPTION OF THE PREFERRED EMBODIMENT

Figure 1:
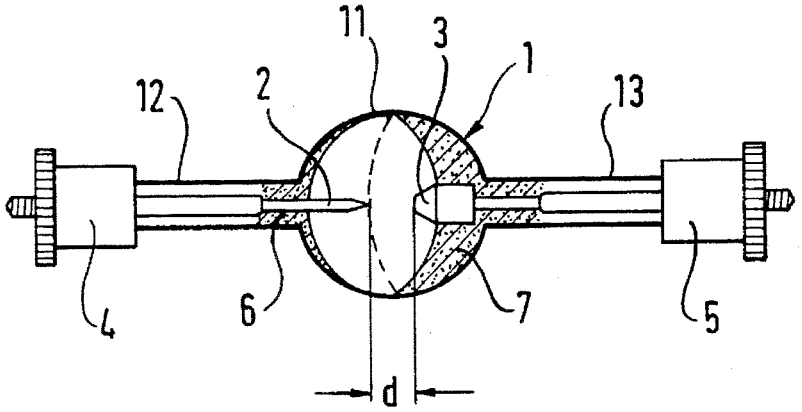
FIG. 1 is a diagrammatic representation of an embodiment of the cadmium/rare gas discharge lamp of the short arc type according to the invention.

FIG. 1 diagrammatically shows an embodiment of the cadmium/rare gas discharge lamp of the short arc type according to the invention. In the representation, a reference symbol 1 designates an arc tube made of quartz that has, in the middle, an enclosed, oval emission space 11 on both ends of which are hermetically sealed parts 12 and 13.

A cathode 2 and an anode 3 are spaced apart by a distance d of about 2 mm to 6 mm inside enclosed emission space 11. The ends of parts 12 and 13, hermetically sealed in pairs, are each provided with bases 4 and 5, and on the sides at which cathode 2 and anode 3 extend from enclosed emission space 11, thermal insulation films 6 and 7 are placed to keep constant a vapor pressure with a certain minimum value and in a way that the exiting of radiant light is not prevented.

Figure 2:
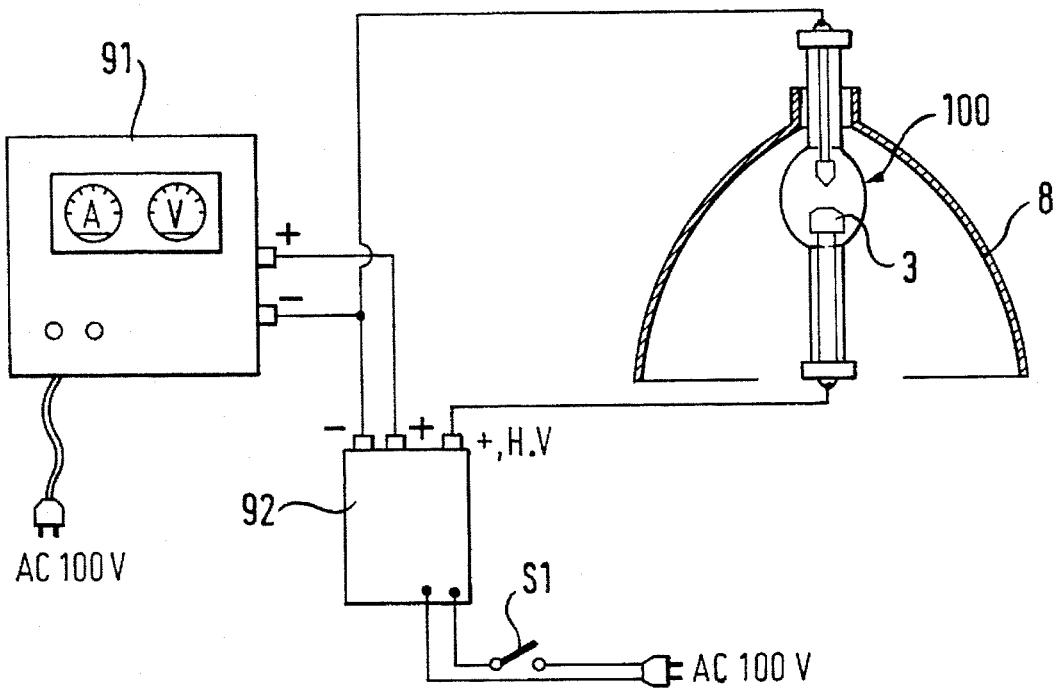
FIG. 2 is a diagrammatic representation of an electric circuit that is suitably used for a lighting operation of the cadmium/rare gas discharge lamp of the short arc type according to the invention.

FIG. 2 is a block diagram of an electric circuit that is suitably used as the current source for the cadmium/rare gas discharge lamp of the short arc type according to the invention. In the representation, this electric circuit is a constant electric circuit that has a constant-current source 91 and a starter 92.

A cadmium/rare gas discharge lamp of the short arc type 100 is inserted into a focussing mirror 8, and by closing a switch S1 of output starter 92 of constant-current source 91, a high voltage is produced in starter 92. By applying the voltage at anode 3 of the cadmium/rare gas discharge lamp of the short arc type 100, a disruption of the discharge of this lamp is produced. Then, by feeding the current from constant-current source 91, an uninterrupted arc discharge is maintained. By regulating the output current from this constant-current source, a stable arc discharge, and thus, a stabilization of the light output, can be achieved.

Inside enclosed emission space 11, metal cadmium and rare gas are encapsulated, for which one of the rare gases krypton, xenon, argon or neon, or several of these rare gases, is/are used. This metal cadmium is encapsulated in an amount that makes it possible to have a pressure in a stationary lighting operation of 14 kPa to 200 kPa. The encapsulation amount of cadmium in this range makes it possible to achieve an approximately acute-angle shape of spectra in a wavelength range of 210 nm to 230 nm and a high efficiency of greater than or equal to 0.8% and high power. But, with a cadmium vapor pressure at which the pressure in stationary lighting operation is smaller than 14 kPa or greater than 200 kPa, the efficiency was less than or equal to 0.7%.

Figure 3:
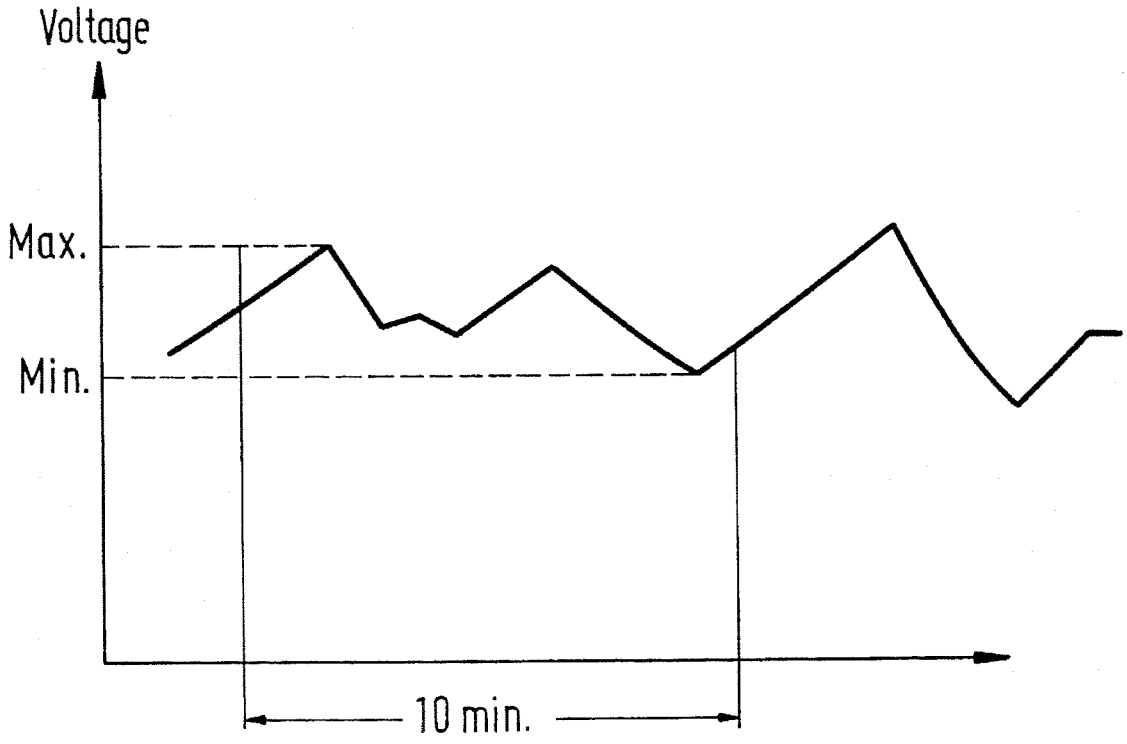
FIG. 3 is a graphic representation that reflects a measuring process for investigating a fluctuation of a lamp in which the lamp, after a lighting operation of any duration, is subjected to an uninterrupted lighting operation of 10 minutes for measuring purposes.

Next, lamps were produced in which the quartz glass materials used for the arc tubes exhibit various OH radical contents, and were subjected to an examination of burning duration. Here, in each case, a lighting duration was measured in which a fluctuation of the lamp voltage was recognized as an unstable circumstance, i.e., was greater than or equal to 5%. FIG. 3 shows the measured light fluctuation.

The measurement was performed so that the lamps, after a lighting operation of any duration, were subjected to an uninterrupted lighting operation of 10 minutes for measurement purposes, and so that their fluctuations were investigated. A regulation can be calculated according to the following formula:

$$(2(\text{max. value}-\text{min. value})/(\text{max value}+\text{min. value}))\times 100\ (\%).$$

Figures 4, 5:
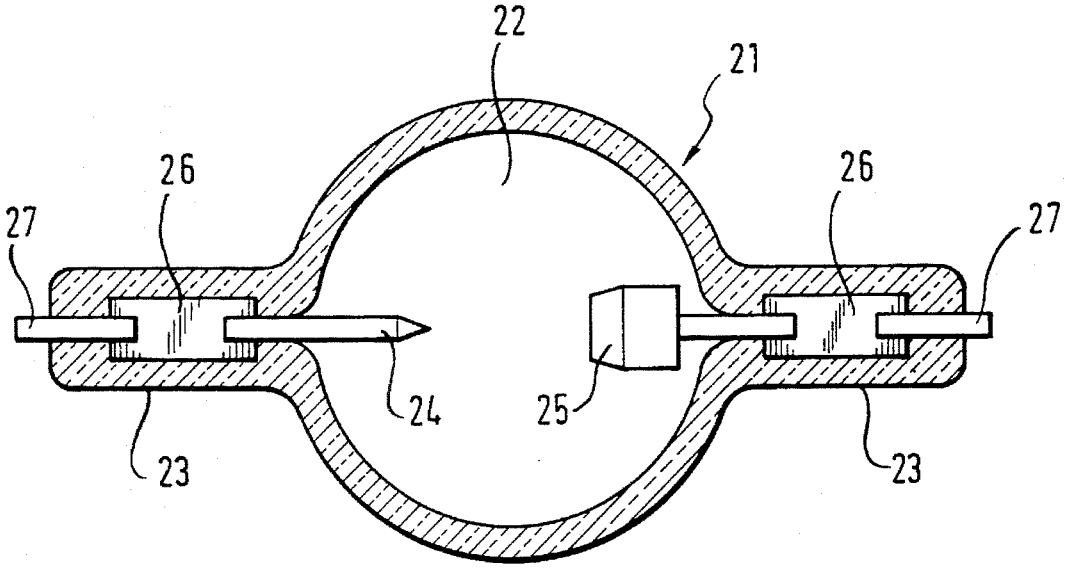
FIG. 4, a tabular representation of data that reflect the relationship between an OH radical concentration at a weight-ppm in quartz glass and a lighting period of the lamp.
FIG. 5 is a diagrammatic cross-sectional representation of another embodiment of the cadmium lamp according to the invention.

This formula means that a difference between a maximum value and a minimum value is divided by an average value, i.e., by a value at which a sum of the maximum value and the minimum value is divided by 2. A value calculated this way is represented by a percentage (%). FIG. 4 shows the result.

FIG. 4 shows data that reflect the relationship between an OH radical concentration as a weight-ppm in quartz glass and a lighting duration of the lamp until the above-described regulation of 5% is achieved.

From these data, it can be seen that, with a lamp with a lifetime of 300 hours, in which a regulation of the lamp voltage of less than or equal to 5% can be maintained, the OH radical concentration in the quartz glass used for the arc tube must be at a weight of less than or equal to 200 ppm.

As described above, with the measure according to the invention in which, in a cadmium/rare gas discharge lamp of the short arc type, in which rare gas is encapsulated inside an are tube together with metal cadmium at a pressure of 14 kPa to 200 kPa in a stationary lighting operation, for which one of the rare gases xenon, krypton, argon or neon, or several of these rare gases is/are selected, quartz glass is used as the material for the arc tube whose OH radical content is at a weight less than or equal to 200 ppm, a lamp is achieved in which, despite a long lighting duration, a limited fluctuation in the lamp voltage occurs.

Because of a stabilization of the lamp voltage achieved because of this, a high power of the spectra in a wavelength range of 210 nm to 230 nm can further be achieved.

FIG. 5 shows diagrammatically an embodiment of the cadmium lamp according to the invention. In the representation, reference numeral 21 designates an arc tube of the cadmium lamp made of transparent glass. Arc tube 21 has, in the middle, an inside space 22 that encloses a discharge. On both ends of arc tube 21, a sealed portion 23 is provided. Within inside space 22, a cathode 24 and an anode 25 are placed opposite one another. The base of cathode 24 and the base of anode 25 are, in each case, connected to a metal foil 26 of sealed portion 23. Metal foils 26 are each connected to an outside base pin 27.

The distance between cathode 24 and anode 25 is less than or equal to 10 min. This cadmium lamp is a lamp of the electrode-stable type, i.e., a lamp whose arc is stabilized by the electrodes. Cadmium is encapsulated within inside space 22 of the cadmium lamp as the main emission substance. This cadmium lamp is distinguished in that, in a cadmium/rare gas discharge lamp of the short arc type in which, inside an arc tube provided with a thermal insulation means, there is a pair of electrodes placed opposite one another less than or equal to 10 mm apart and, with a lamp current of greater than or equal to 20 amperes, an arc of the electrode-stable type is formed. The rare gas encapsulated is one of the rare gases neon, argon or krypton or several of these rare gases, and the above-described rare gas is encapsulated at an encapsulation pressure of 35 kPa to 2.5 MPa at a standard-temperature of 25° C.

The encapsulated main emission substance Cd can also be encapsulated as a halogen compound. To achieve an emission intensity usable for industrial applications, an outer tube of the double-tube type or thermal insulation means of other designs can also be used to increase the vapor pressure of the cadmium.

With a cadmium lamp with this type of arrangement, a sufficient radiation intensity can be achieved if the lighting operation is performed at a lamp current of less than 20 amperes. If, in doing so, the distance between the electrodes is greater than 10 ram, the arc of the electrodestable type cannot be formed in a simple way.

Here, as the test object/sample, 11 lamps were produced by establishing, in the above-described cadmium lamp, a distance between the electrodes of 5 mm, an internal volume of the arc tube of 25 cc and encapsulating 16 mg of metal cadmium. Furthermore here, for comparison purposes, Xe gas, which is a usually used inert gas, is encapsulated in cadmium lamps A to C.

In cadmium lamps D to K according to the invention, rare gas Kr, Ar or Ne is encapsulated as the inert gas.

Below, the various types of encapsulated gases and the encapsulation pressure for each cadmium lamp are shown:

Cadmium lamp A Xe gas, 0.05 MPa

Cadmium lamp B Xe gas, 0.36 MPa

Cadmium lamp C Xe gas, 1.00 MPa

Cadmium lamp D Kr gas, 0.04 MPa

Cadmium lamp E Kr gas, 0.34 MPa

Cadmium lamp F Kr gas, 0.89 MPa

Cadmium lamp G Ar gas, 0.04 MPa

Cadmium lamp H Ar gas, 0.30 MPa

Cadmium lamp I Ar gas, 1.10 MPa

Cadmium lamp J Ne gas, 0.05 MPa

Cadmium lamp K Ne gas, 0.22 MPa

Figure 6:
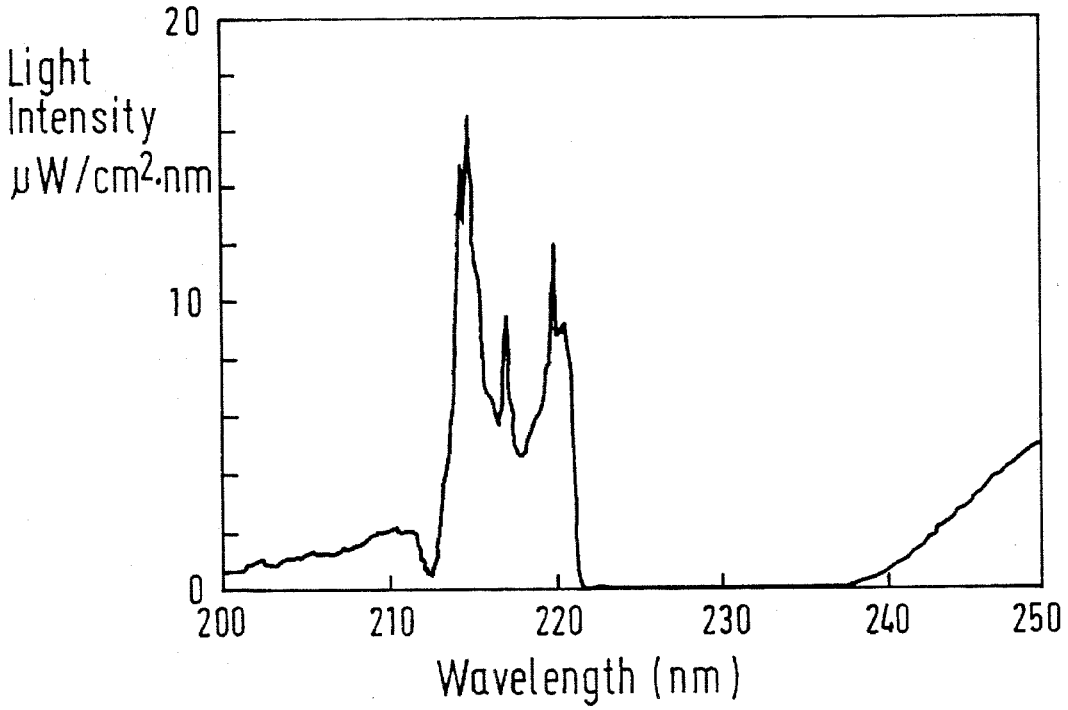
FIG. 6 is a graphic representation of relative spectra in a radiation wavelength range of 200 nm to 250 nm of a cadmium lamp according to FIG. 5 that is operated with 16 mg of metal cadmium, 0.30 MPa rare gas Ar, a lamp current of 70.5 amperes, and a lamp voltage of 23.1 V.

Cadmium lamp H was operated with a lamp current of 70.5 amperes and a lamp voltage of 23.1 V and, after 30 minutes, was subjected to a measurement by a spectrometer calibrated by a deuterium lamp and a halogen lamp. FIG. 6 shows an example of relative distribution spectra in the wavelength range of 200 nm to 250 nm radiated from the cadmium lamp measured by this spectrometer.

An integrated value of the measured relative radiation spectra in a wavelength range of 214 nm to 221 nm is designated as relative radiation intensity by Q. A relative light efficiency of lamp η can be calculated according to the formula:

$$\eta = Q/(I_L \cdot V_L).$$

where, $I_L$ designates a lamp current in a lighting operation and $V_L$ a lamp voltage.

The lamps for comparative purposes and the lamps according to the invention are compared to one another, so that a relative light efficiency η of cadmium lamp B is set as 1, in which the usually used Xe gas is encapsulated at room temperature at an encapsulation pressure of 0.36 MPa. FIG. 7 shows data of a comparative example in which conventional cadmium lamps A to C and cadmium lamps D to K according to the invention were investigated by considering the types of encapsulated gases and the encapsulation pressures of the gases as parameters.

As can be seen from FIG. 7, an improvement in the light efficiency of cadmium lamp B as comparative reference to greater than or equal to 1.50 is made possible by using Kr, Ar and Ne as inert gases. Especially by encapsulating Ar and Ne at an encapsulation pressure of greater than or equal to 0.1 MPa, a light efficiency is achieved that, in comparison to the comparative examples with the encapsulation of Xe, is 2.01 to 2.63 times (with encapsulation of Ar) and 2.14 times (with encapsulation of Ne) as high. From this it can be seen that the improvement in light efficiency with encapsulation of Ar and Ne is extraordinarily great. With these data, cases in which the relative light efficiency is greater than or equal to 1.50 were judged to have an identifiable, considerable increase in light efficiency, provided that the relative light efficiency of lamp B is taken as the norm with the value 1, in which, at room temperature, Xe is encapsulated at an encapsulation pressure of 0.36 MPa.

Figure 8:
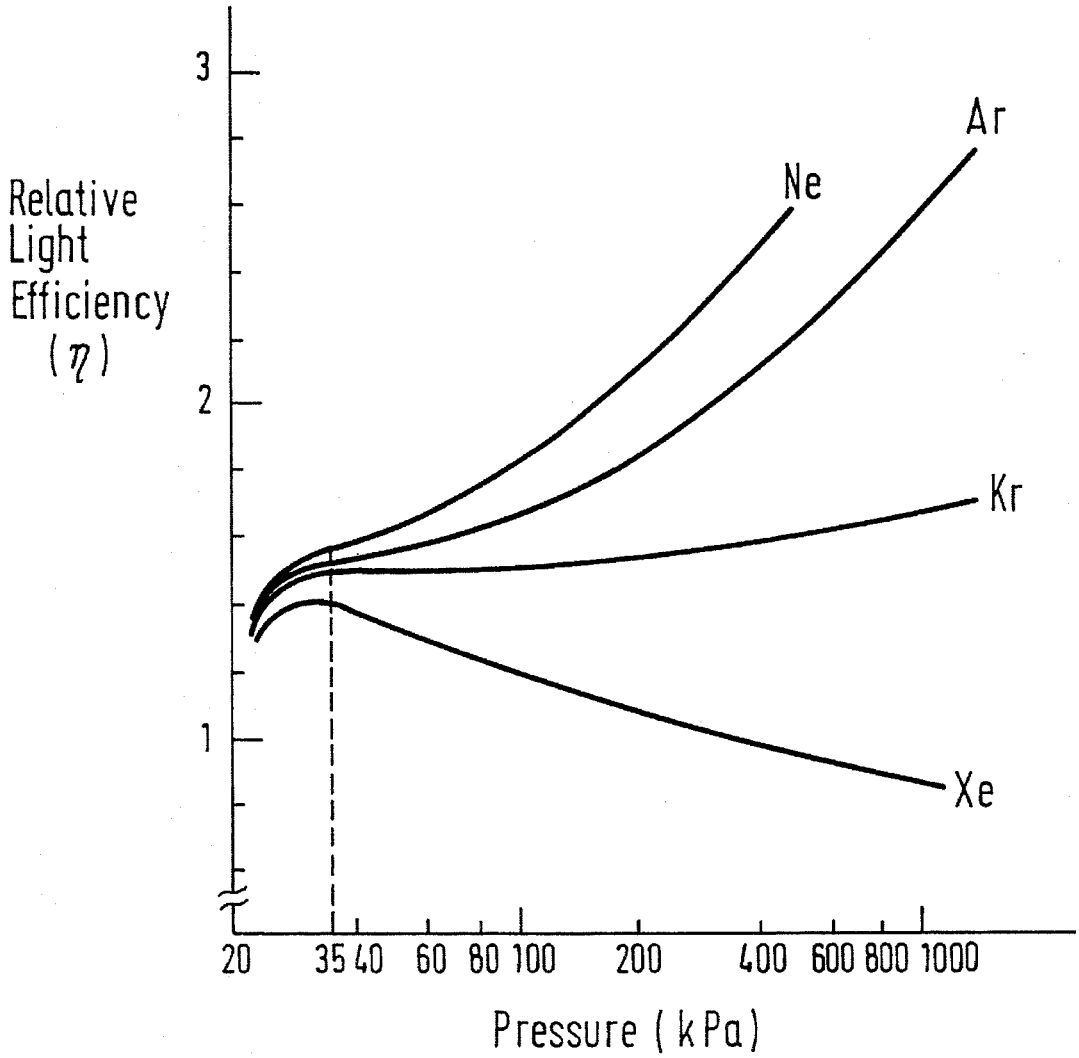
FIG. 8 is a graphic representation of the results of tests in which changes of the respective encapsulated gas pressure of the rare gases Xe, Kr, Ar and Ne, and corresponding changes of a relative light efficiency were investigated, in lamps according to FIG. 5.

FIG. 8 shows the results of the test in which the light efficiency was investigated with respect to the pressure of the encapsulation gas, together with the results shown in FIG. 7. FIG. 8 graphically shows data on the relative light efficiency for which, in cadmium lamps with a rated consumption of 2 KW and a current of 50 to 100 amperes, encapsulated gases were considered as parameters. The encapsulation gas pressure designates a pressure at room temperature and the types of encapsulated gases are represented as parameters. The scale of the abscissa here is a logarithmic scale.

As can be seen from FIG. 8, Cadmium lamps in which Kr, Ar and Ne are encapsulated as inert gases, at an encapsulation pressure of greater than or equal to 35 kPa of the inert gases; exhibit a better light efficiency than cadmium lamps with Xe as the inert gas. If, on the other hand, Kr, Ar and Ne are encapsulated as inert gases at an encapsulation pressure of less than 35 kPa, it is true that a light efficiency is achieved that is somewhat greater than with encapsulation of Xe or that is about as great as with encapsulation of Xe, but, no considerable difference in effect could be detected.

With this test, using cadmium lamp G, the relationship between relative light efficiency and an input current was investigated. Here, it turned out that, with lighting operations at various lamp currents in a range from 50 amperes to 130 amperes, the amount of change in relative light efficiency was within about 5% and thus, no significant difference was detected. That is, at a lamp current of 50 amperes and an input power of 0.97 KW, Q was 152 and η was 1.57, and at a lamp current of 130 amperes and an input power of 2.73 KW, Q was 412 and η was 1.52.

As described above, according to the invention a cadmium/rare gas discharge lamp of the short arc type is indicated that has a high output of shortwave ultraviolet rays. The output is based on an increase in the gas temperature inside the arc, a taking over, by the ions of the emission substance, as the main carrier of the lamp current, an effective excitation of the emission substance and an increase in the density of the distribution number of the highly excited state connected with the emission.

Figure 9:
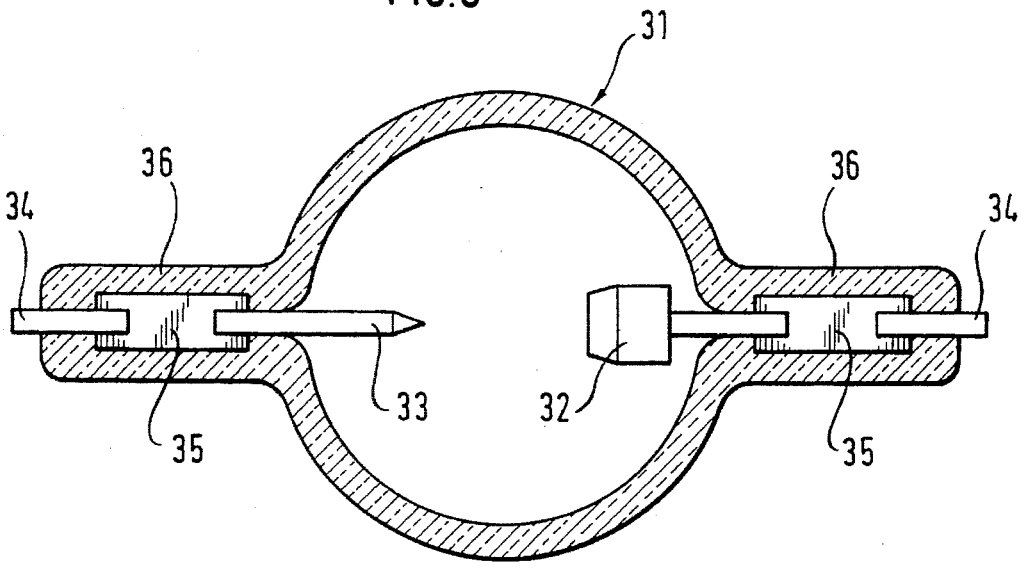
FIG. 9 is a diagrammatic cross-sectional representation of an embodiment of another cadmium lamp according to the invention.

FIG. 9 diagrammatically shows, in a cross-sectional representation, another embodiment of a cadmium lamp according to the invention. In the representation, a reference symbol 31 designates an arc tube made of quartz glass. The middle of arc tube 31 is approximately spherical and exhibits a maximum inner diameter of 17 mm with anode 32 and cathode 33 being spaced about 3 mm apart from each other therein. The base of anode 32 and the base of the cathode 33 are each connected to a metal foil 35 that is hermetically sealed inside sealed portion 36. Metal foils 35 are each connected to an outside base pin 34.

In the lamp with the above-described arrangement, argon at 100 kPa as the starter rare gas, $9.0\times10^{-6}$ mol/cm$^3$ of metal cadmium and $3.0\times10^{-8}$ mol/cm$^3$ iodine as the halogen are encapsulated in arc tube 31.

The encapsulated halogen, which here is iodine, can also be a halogen-molecule-element, or it can also be a metal halogenide, such as cadmium halogenide, mercury halogenide, or the like.

Test 1

A cadmium lamp that exhibits the same lamp arrangement as in the first embodiment and in which iodine is encapsulated in an amount fulfilling the necessary condition according to the invention, a cadmium lamp in which iodine is encapsulated in an amount not corresponding to the necessary condition according to the invention, and a cadmium lamp that contains no iodine were produced to perform a comparative test on the degree to which the emission intensity is maintained.

Figure 10:
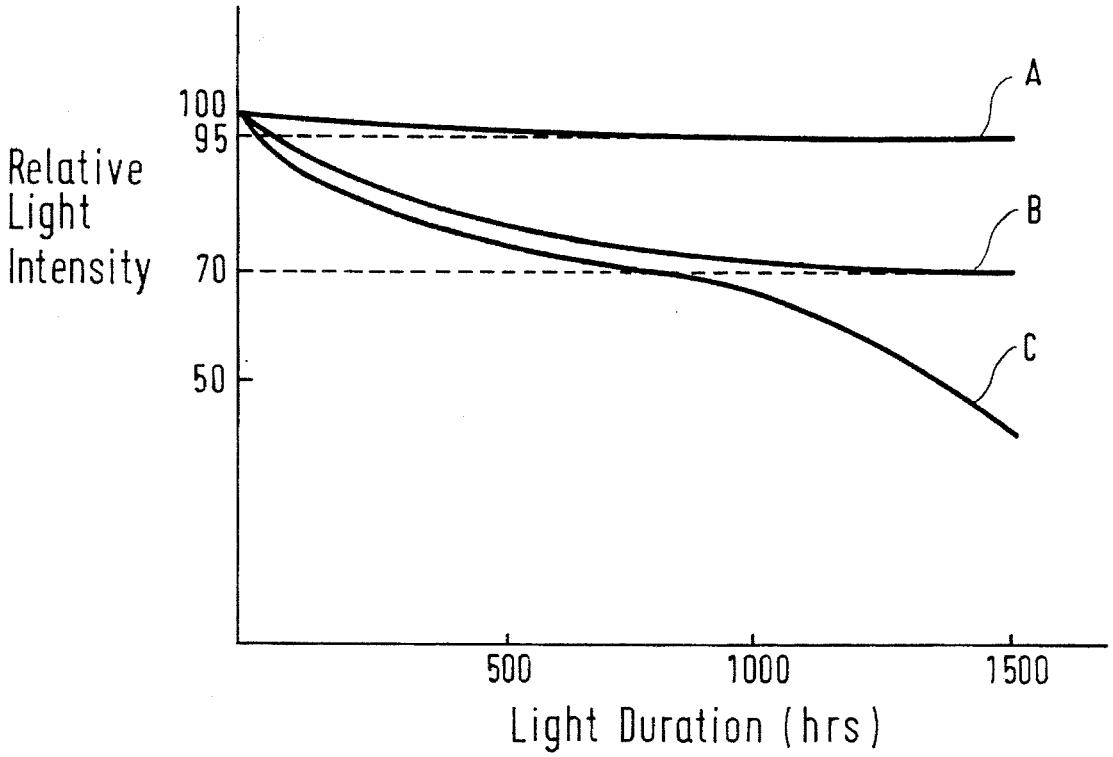
FIG. 10 is a graphic representation of data in which, for each of three cadmium lamps according to FIG. 9, emissions in a wavelength range of 200 nm to 250 nm were measured at each point in time and changes in the light intensity of the respective cadmium lamp were compared.

The test results are shown in FIG. 10, which is a graphic depiction of data for each of the above-described three cadmium lamps, where radiant light in a wavelength range of 200 nm to 250 nm was measured at each point in time and changes in the light intensity of the respective cadmium lamp were compared. The ordinate represents a relative light intensity in relative terms based on the light intensity at starting lighting operation being designated as 100, and the abscissa represents the lighting duration in hours.

In the representation, a curve A designates data on the cadmium lamp of the first embodiment. A curve B reflects data on the cadmium lamp that exhibits the same lamp arrangement as in the first embodiment, and in which $3.0\times10^{-10}$ mol/cm$^3$ of iodine is encapsulated. A curve C shows data on the cadmium lamp that exhibits the same lamp design as in the first embodiment and in which no iodine is encapsulated.

As can be seen from FIG. 10, for the cadmium lamp represented by curve C, in which no iodine was encapsulated, within a lighting duration of 800 hours, as a result of devitrification, a decrease to less than or equal to 70% of the starting light intensity occurred. On the other hand, for the cadmium lamp represented by curve B, in which $3.0\times10^{-10}$ mol/cm$^3$ of iodine was encapsulated, within a lighting duration of >1,500 hours, as a result of devitrification, a decrease to less than or equal to 70% of the starting light intensity occurred. However, for the cadmium lamp of the first embodiment, represented by curve A, it turned out that, after a lighting duration of 1,500, a light intensity of greater than or equal to 95% of the starting light intensity was maintained.

From this it was seen that, with a long lighting duration of a cadmium lamp, a decrease in light intensity as a result of the devitrification phenomenon, in comparison to a cadmium lamp in which no iodine is encapsulated, can be suppressed up to a certain degree if iodine is encapsulated in an amount of at least $3.0\times10^{-10}$ mol/cm$^3$. Further, it was determined that, by encapsulating iodine in an amount of $3.0\times10^{-10}$ mol/cm$^3$, which fulfills the necessary condition according to the invention, the devitrification phenomenon can advantageously be sufficiently prevented and the light intensity can be maintained substantially at its startup light intensity for a long period.

Test 2

Next, a test was performed in which, using a cadmium lamp with the same lamp design as in the first embodiment, changes in the startup light intensity were investigated by changing the amount of iodine encapsulated as the halogen in this cadmium lamp. The test results are shown in FIG. 11 which is a graphical representation of data reflecting the relationship between the amount of iodine encapsulated and a startup relative light intensity.

Figure 11:
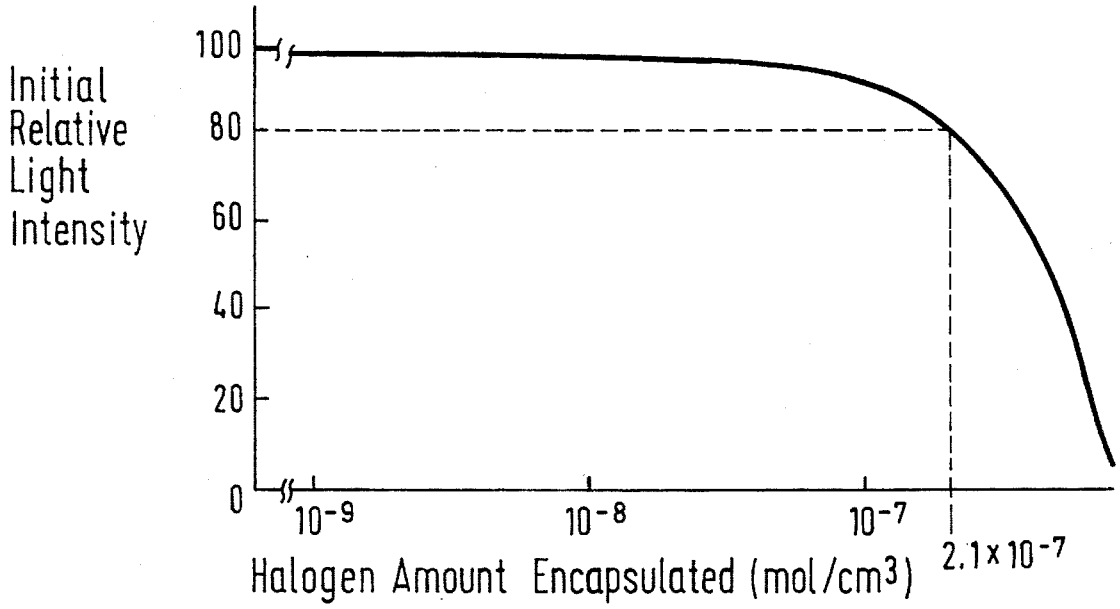
FIG. 11 is a graphic representation of data that reflect a relationship between an encapsulation amount of iodine and a startup relative light intensity for lamps according to FIG. 9.

In FIG. 11, the ordinate represents a startup relative light intensity in relative terms based on the light intensity at startup of the lighting operation being designated 100 in the case where halogen is not encapsulated, and the abscissa represents the amount of halogen encapsulated in mol/cm$^3$ units.

As can be seen from FIG. 11, the startup light intensity decreases if the amount of encapsulated iodine increases, this decrease reaching 80% of the startup intensity of a cadmium lamp in which no iodine is encapsulated when at an iodine amount of $2.1\times10^{-7}$ mol/cm$^3$. When iodine is encapsulated in an amount greater than or equal to $2.1\times10^{-7}$ mol/cm$^3$, the above-described light absorption phenomenon of iodine itself as a halogen clearly occurs, and the light intensity decreases rapidly from this point on. From this it can be seen that the amount of iodine to be encapsulated should be no more than $2.1\times10^{-7}$ mol/cm$^3$.

Test 3

Further, using a cadmium lamp with the same lamp arrangement as in the first embodiment, a test was performed in which the amount of iodine as the halogen to be encapsulated in this Cadmium lamp was changed and the degree to which the light intensity was maintained after a lighting duration of 1,500 hours was investigated.

Figure 12:
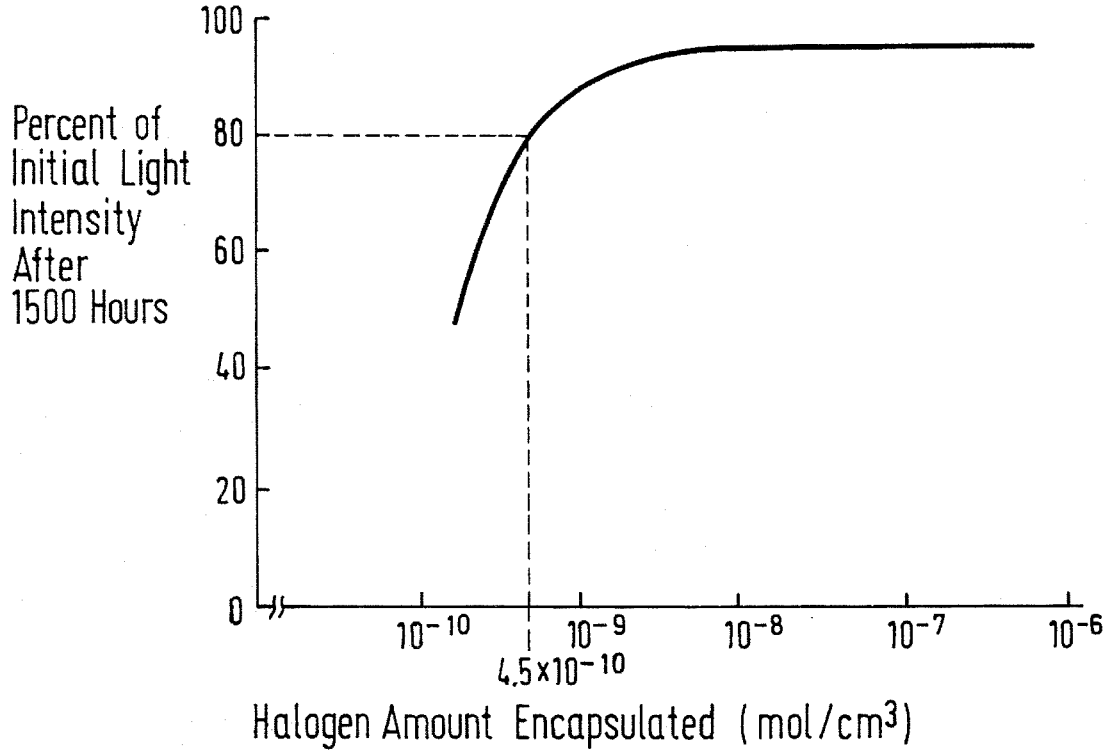
FIG. 12 is a graphic representation of data that reflect a relationship between the encapsulation amount of the iodine and a relative degree of maintaining the light intensity after a lighting duration of 1,500 hours for lamps according to FIG. 9.

FIG. 12 is a diagrammatic representation of data that reflect a relationship between the encapsulation amount of iodine and a relative degree of light intensity maintenance after a lighting duration of 1,500 hours.

In FIG. 12, the ordinate represents the relative light intensity maintenance degree (as a percentage of the original intensity) after a lighting duration of 1,500 hours and the abscissa represents the amount of the halogen encapsulated (in units of mol/cm$^3$).

As can be seen from FIG. 12, the relative degree of light intensity maintenance decreases after a lighting duration of 1,500 hours if the amount of iodine encapsulated is decreased, and is only 80% of its original intensity with an iodine amount of $4.5\times10^{-10}$ mol/cm$^3$. With an iodine amount of less than or equal to $4.5\times10^{-10}$ mol/cm$^3$, it is evident that a sharp decrease in the relative degree to which the light intensity is maintained clearly occurs, and sufficient prevention of devitrification cannot be achieved. From this, it can be seen that a desired encapsulation amount of iodine is at least $4.5\times10^{-10}$ mol/cm$^3$.

Below, another, second embodiment of a cadmium lamp according to the invention is described in which, as the halogen to be encapsulated, bromine is used instead of iodine. The cadmium lamp used in the second embodiment has the same arrangement as in the first embodiment. The encapsulation amount of bromine is also, as in the first embodiment, $3.0\times10^{-8}$ mol/cm$^3$.

Using a cadmium lamp according to the second embodiment, the above described tests 1 and 2 were performed. Here, the same results were able to be achieved in as in tests 1 and 2 with the use of iodine. That is, no difference was detectable due to the different halogens iodine and bromine.

(Test 4)

Next, using the cadmium lamp according to the first embodiment and the cadmium lamp according to the second embodiment, a test was performed in which a relationship between a deviation from an average voltage and a lighting duration was investigated.

Figure 13:
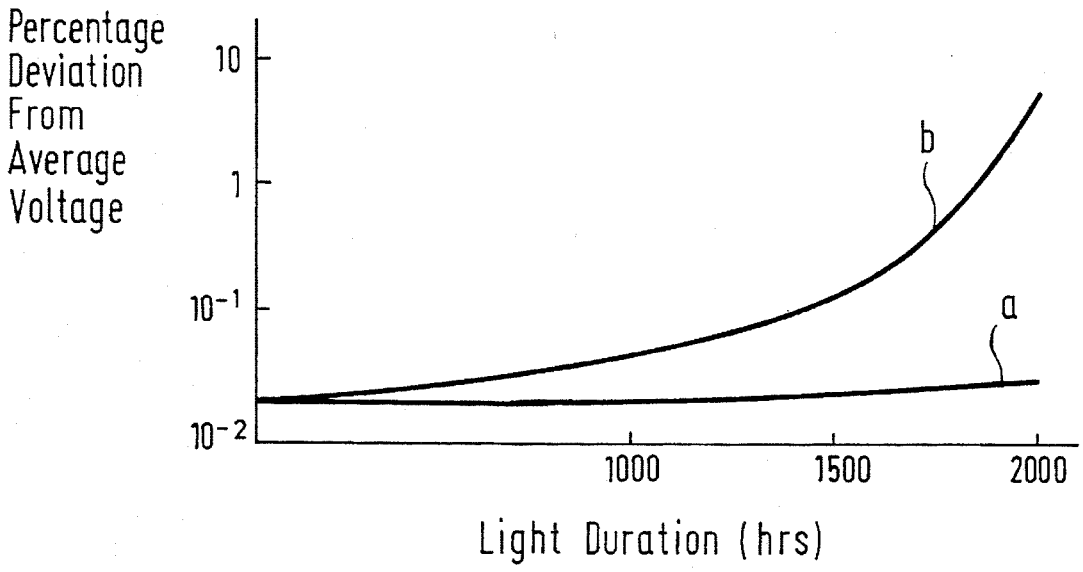
FIG. 13 is a graphic representation of data that reflect a relationship between a light duration and a deviation from an average voltage for lamps according to FIG. 9.

In the cadmium lamp according to the first embodiment, iodine was encapsulated in an amount of $3.0\times10^{-8}$ mol/cm$^3$ and, in the cadmium lamp according to the second embodiment, bromine was encapsulated in an amount of $3.0\times10^{-8}$ mol/cm$^3$. The test result is represented in FIG. 13. FIG. 13 is a graphic depiction of data that reflect a relationship between the lighting duration and the voltage deviation from the average voltage. The ordinate is a logarithmic scale to designate the percentage of deviation from the average voltage, and the abscissa represents the lighting duration in hours. The voltage deviation was measured by subjecting a lamp, after any lighting duration, to an uninterrupted lighting operation of 10 minutes for measurement purposes and a fluctuation of it was investigated.

A regulation of it can be calculated according to the following formula.

$$(2(\text{max. value}-\text{min. value}/\text{Max. value}-\text{min. value}))\times100(\%).$$

This formula means that a difference between a maximum value and a minimum value is divided by an average value, i.e., by a value at which a sum of the maximum value and the minimum value is divided by 2. A value calculated this way is represented as a percentage (%).

As can be seen from FIG. 13, at the beginning of the lighting operation, no clear difference was detectable between the two cadmium lamps. At the end of a lighting duration of 1,000 hours, the cadmium lamp according to the first embodiment with encapsulated iodine shows, corresponding to curve a, that the relationship of the deviation from the average voltage was 0.02%, and the cadmium lamp according to the second embodiment, corresponding to curve b, shows that the relationship of the deviation from the average voltage is 0.04%.

At the end of a lighting duration of 1,500 hours, the relationships of the deviation from the average voltage are 0.02% for curve a and 0.14% for curve b.

At the end of a lighting operation of 2,000 hours, the relationships of the deviation from the average voltage are 0.03% for curve a and 5% for curve b.

A lighting operation of a cadmium lamp at a constant input power, which is represented by curve b, i.e., in which bromine is encapsulated, is made possible only by building a feedback circuit into a current source or by similar means.

On the other hand, in a cadmium lamp represented by curve a, i.e., in which iodine is encapsulated, no special arrangement is necessary for the current source, because the relationship of the deviation from the average voltage here is small and a temporal change is also small.

As it is described above, by the measure according to the invention in which halogen is encapsulated in a cadmium lamp in an amount of $4.5\times10^{-10}$ mol/cm$^3$ to $2.1\times10^{-7}$ mol/cm$^3$, when it is converted into diatomic molecules, a slight incidence of devitrification on the inner side of the tube is prevented and light absorption by the halogen can simultaneously be reduced. Consequently, according to the invention, light at a high intensity can be achieved over a long period and the recently existing need by the photochemical industries, production fields of semiconductor devices or the like can be met.

It is to be understood that although preferred embodiments of the invention have been described, various other embodiments and variations may occur to those skilled in the art. Any such other embodiments and variations which fall within the scope and spirit of the present invention are intended to be covered by the following claims.

We claim:

1. Cadmium rare gas discharge lamp of the short arc type having cadmium as a main emission substance and free of mercury as a main emission element, said lamp comprising an arc tube provided with a pair of opposed, spaced electrodes therein and a rare gas encapsulated together with metal cadmium and a halogen gas, the rare gas being selected from the group consisting of at least one of the rare gases, krypton, argon or neon, and the metal cadmium being said main emission substance and forming a means for emitting light with a spectrum which is intensified in a wavelength range of 210–230 nm, and the halogen gas being encapsulated in an amount from $4.5\times10^{-10}$ mol/cm$^3$ of arc tube volume to $2.1\times10^{-7}$ mol/cm$^3$ of arc tube volume based on diatomic halogen molecules.

2. Cadmium rare gas discharge lamp of the short arc type according to claim 1, wherein the rare gas is encapsulated at an encapsulation pressure of 35 kPa to 2.5 MPa at a standard temperature of 25° C.

3. Cadmium rare gas discharge lamp of the short arc type according to claim 1, wherein said arc tube is provided with a thermal insulation; wherein said pair of opposed electrodes located in said arc tube are spaced apart from one another by no more than 10 mm; and wherein the cadmium metal and the rare gas are encapsulated within the arc tube for forming an arc of the electrode-stable type and radiant light of Cd ions with said spectrum which is intensified in a wavelength range of 210–230 nm from a lamp current of at least 20 amperes.

4. Cadmium metal vapor discharge lamp of the short arc type, according to claim 1, wherein said halogen gas is iodine.

5. Cadmium rare gas discharge lamp of the short arc type according to claim 1, wherein said arc tube is formed of a quartz glass having an OH radical content of a weight of no more than 200 ppm.

* * * * *